US010112068B2

(12) United States Patent
Medina

(10) Patent No.: US 10,112,068 B2
(45) Date of Patent: Oct. 30, 2018

(54) EXERCISE APPARATUS AND METHOD

(71) Applicant: Dov Medina, Forest Hills, NY (US)

(72) Inventor: Dov Medina, Forest Hills, NY (US)

( * ) Notice: Subject to any disclaimer, the term of this patent is extended or adjusted under 35 U.S.C. 154(b) by 284 days.

(21) Appl. No.: 14/617,895

(22) Filed: Feb. 9, 2015

(65) Prior Publication Data

US 2015/0367160 A1 Dec. 24, 2015

Related U.S. Application Data

(60) Provisional application No. 61/948,565, filed on Mar. 6, 2014, provisional application No. 62/046,156, filed on Sep. 4, 2014.

(51) Int. Cl.

| | |
|---|---|
| ***A63B 21/02*** | (2006.01) |
| ***A63B 21/055*** | (2006.01) |
| ***A63B 5/20*** | (2006.01) |
| ***A63B 21/00*** | (2006.01) |
| ***A63B 23/035*** | (2006.01) |
| *A63B 23/12* | (2006.01) |
| *A63B 23/00* | (2006.01) |

(52) U.S. Cl.

CPC ..... *A63B 21/0557* (2013.01); *A63B 5/20* (2013.01); *A63B 21/00043* (2013.01); *A63B 21/00069* (2013.01); *A63B 21/0555* (2013.01); *A63B 21/4035* (2015.10); *A63B 21/4043* (2015.10); *A63B 23/03533* (2013.01); *A63B 23/1209* (2013.01); *A63B 2023/006* (2013.01); *A63B 2225/09* (2013.01)

(58) Field of Classification Search

CPC ..... A63B 21/0557; A63B 21/00069; A63B 23/03533; A63B 21/0555; A63B 21/4035; A63B 5/20; A63B 21/00043; A63B 21/4043; A63B 2023/006; A63B 2225/09

USPC ..... 482/121–127, 139, 148, 44–50, 81–82, 482/110

See application file for complete search history.

(56) References Cited

U.S. PATENT DOCUMENTS

| | | | | |
|---|---|---|---|---|
| 3,427,023 A * | 2/1969 | Silberman | A63B 21/0004 | 24/630 |
| 3,589,721 A * | 6/1971 | Cronauer | A63B 21/0004 | 482/125 |
| 4,328,964 A * | 5/1982 | Walls | A63B 21/4035 | 473/229 |
| 5,478,297 A * | 12/1995 | Dennis, Jr. | A63B 5/20 | 482/81 |
| 6,497,641 B1 * | 12/2002 | Hinds | A63B 21/00043 | 482/121 |
| 6,676,576 B1 * | 1/2004 | Wu | A63B 21/0004 | 482/126 |
| 6,860,841 B1 * | 3/2005 | Mortorano | A63B 21/0004 | 482/126 |
| 7,147,592 B2 * | 12/2006 | Hinds | A63B 21/0552 | 482/126 |

(Continued)

*Primary Examiner* — Garrett Atkinson

(74) *Attorney, Agent, or Firm* — Gearhart Law LLC

(57) ABSTRACT

An apparatus includes an elastic portion comprised of one or more elastic members which interconnects a pair of spaced apart handles. Each of the handles includes a structural feature which allows the orientation of a handle grip axis to be readily adjusted relative to the extended direction of the elastic portion in order to achieve a configuration respectively suited to either aerobic, jump rope activity, or to resistance training and stretching.

19 Claims, 7 Drawing Sheets

(56) References Cited

U.S. PATENT DOCUMENTS 7,322,907 B2 * 1/2008 Bowser ..... A63B 23/1209 482/121
7,377,886 B2 * 5/2008 Wu ..... A63B 21/0004 482/121
7,431,680 B1 * 10/2008 Hinds ..... A63B 21/0552 482/44
7,448,990 B2 * 11/2008 Wu ..... A63B 21/0004 482/121
7,465,258 B1 * 12/2008 Mortorano ..... A63B 21/0004 482/126
7,465,259 B2 * 12/2008 Mok ..... A63B 21/0004 482/121
7,578,775 B2 * 8/2009 Terry ..... A63B 21/0004 482/121
7,625,324 B1 * 12/2009 Hinds ..... A63B 21/4035 482/121
7,922,634 B1 * 4/2011 Wu ..... A63B 21/0004 482/121
8,075,462 B1 * 12/2011 Hinds ..... A63B 21/00061 482/125
8,088,047 B2 * 1/2012 Marji ..... A63B 5/20 482/82
8,491,446 B2 * 7/2013 Hinds ..... A63B 21/0055 482/126
8,821,355 B2 * 9/2014 Daniels ..... A63B 5/20 482/82
8,876,678 B2 * 11/2014 Flentye ..... A63B 21/0552 482/121
8,944,975 B2 * 2/2015 Hsieh ..... A63B 21/0442 482/124
8,961,379 B2 * 2/2015 Flentye ..... A63B 21/0552 482/121
8,986,173 B1 * 3/2015 Adams ..... A63B 21/028 482/106
9,186,535 B2 * 11/2015 Ercanbrack ..... A63B 21/4023
2005/0075223 A1 * 4/2005 Wu ..... A63B 21/0004 482/126
2006/0052223 A1 * 3/2006 Terry ..... A63B 21/0004 482/126
2006/0094573 A1 * 5/2006 Weck ..... A63B 21/0004 482/126
2006/0105893 A1 * 5/2006 Chen ..... A63B 21/0004 482/126
2013/0288864 A1 * 10/2013 Holland ..... A63B 21/4023 482/126
2014/0228180 A1 * 8/2014 Walker ..... A63B 5/20 482/82

* cited by examiner

EXERCISE APPARATUS AND METHOD

BACKGROUND OF THE INVENTION

The present invention relates to an exercise apparatus, and more particularly, to an exercise apparatus that functions to provide both aerobic and strength training as well as the benefits of stretching to a user.

Exercise apparatuses are known which generally utilize a flexible and stretchable resistance member extending between spaced-apart handle portions. The stretchable member comprises, for example, a bungee cord or a band made of rubber or other elastomeric material. Holding the handles at each end of the stretchable member, and using any of many well known exercise routines in which a portion of the apparatus is anchored to a fixed support, muscle strength training can be achieved by application of repetitive force acting against the elastic resistance to elongation of the stretchable member.

While being quite effective in achieving gains in muscle tone and mass when diligently used as part of an exercise training program, an apparatus of the aforementioned type does not provide the cardiovascular or pulmonary benefits of aerobic exercise.

Jump ropes have long been used to achieve cardiovascular fitness when used regularly in aerobic exercise routines. Such routines generally involve a user holding handles which are disposed at opposed ends of a rope or other flexible member, and skipping or jumping repetitively in synchronization with the rope swung so that it passes under the feet and over the head of the user.

While being capable of imparting the associated cardiovascular benefits attributed to aerobic exercise, jump ropes can provide nothing in the way of resistance training.

Generally speaking, in carrying out an exercise routine of almost any form, whether directed to strength training or cardiovascular workouts, the involved muscles contract in order to achieve flexing of a particular body part or region controlled thereby. Stretching after exercise can help to relieve tension of the involved muscles or muscle groups which have been subjected to repeated contraction.

Stretching in advance of exercise is also believed to help in the prevention of athletic related injuries. The use of stretching before or after exercise can, therefore, be an important part of any strength/endurance program.

Heretofore, it has not been possible to gain the attendant benefits of resistance training, stretching and aerobic exercise by use of a single apparatus.

It would therefore be desirable to provide an apparatus, apparatus feature and method of use which provide the user with a choice of exercise and stretching options using the same apparatus in different ways.

SUMMARY OF THE INVENTION

It is an object of the invention to provide an exercise apparatus which overcomes the drawbacks of the prior art.

In is a further object to provide such apparatus in a form which can easily be selectively and adjustably configured to be suited to a particular exercise being performed.

In accordance with these and other objects of the invention, there is provided an apparatus which comprises an elastic portion comprised of one or more elastic members which interconnects a pair of spaced apart handles. Each of the handles includes a structural feature which allows the orientation of a handle grip axis to be readily adjusted relative to the extended direction of the elastic portion in order to achieve a configuration respectively suited to either aerobic, jump rope activity, or to resistance training and stretching.

An apparatus in accordance with an embodiment of the invention includes an elastic portion comprising at least one flexible elastic member which resists stretchable elongation and which substantially returns to an original length upon release of an applied stress causing the elongation, conveniently comprising, for example, a conventional bungee cord (or two or more bungee cords, for example, optionally braided, etc., for increased resistance). A pair of handles, each includes a grip portion having a longitudinal handle grip axis. The handles are carried on the elastic portion in spaced apart locations therealong, and are structurally configured to allow selective orientation of an extended direction of the elastic portion either codirectional with the handle grip axis or crosswise thereto.

When the apparatus is used for aerobic exercise, the elastic portion is generally used in a first orientation relative to each of the handles, in which the extended direction of the elastic portion is codirectional with the handle grip axis. The handle is structurally configured to allow the elastic portion to be moved to a second orientation in which the extended direction of the elastic portion is oriented crosswise to the handle grip axis. When in this second orientation, the exercise apparatus is generally better suited to use in resistance training and/or for stretching purposes. However, it is noted that some users may prefer the first or second orientations for other than the above noted generally suited purposes, i.e., the first orientation being used for some resistance routines and/or the second orientation for jumping rope. Thus the choice of orientations can, if desired, be left up to the particular user.

In accordance with an advantageous embodiment, each of the pair of handles includes a bore coaxial with the handle grip axis through which the elastic portion is receivable when the apparatus is in the first orientation suited for use as a jump rope. The handles are carried on the elastic portion in spaced apart locations therealong, and each of opposed ends of the elastic portion is advantageously configured in a manner which prevents separation of the elastic portion from the handles. This is conveniently accomplished by the provision of an opening in the grip portion through which the ends of the elastic portion are passed and knotted. As such, the handles are slidable along the elastic portion to allow an adjustment of a distance between the handles, while at the same time, removal of the handles is prevented past the knots when they are moved further apart to the opposed ends of the elastic portion.

A slotted opening is provided in the grip portion which is narrower than a width of the elastic portion when in an un-stretched state, such that the elastic portion is captively held within the coaxial bore for jump rope activity in the first orientation. When the user decides to engage in resistance training or stretching, he/she simply stretches the elastic portion until the width thereof is reduced sufficiently to allow the elastic portion to clear the slotted opening, thereby allowing the elastic portion to be freed from the coaxial bore, and moved into the second orientation crosswise to the coaxial bore.

In accordance with a particularly advantageous embodiment, the handles each further includes an extension portion arranged crosswise to the grip portion, which includes a bore communicative with the coaxial bore running crosswise thereto, and an other slotted opening of like or similar width to the slotted opening in the grip portion and contiguous therewith. Such configuration allows the elastic portion to be moved between the first and second orientation simply by maintaining a stretched state of the elastic portion which sufficiently reduces the width of the elastic portion to allow manually directed transfer of the elastic portion to and from each of the bore (first orientation) and the coaxial bore (second orientation). Removal of the stretching force causes the width of the elastic portion to return to a size which inhibits removal of the elastic portion through either of the slots. Since the forces acting on the elastic portion during resistance training or stretching are codirectional with the bore of the extension portion of the handle, dislodging of the elastic portion from the bore of the extension portion does not occur through the slotted opening, even though the width of the elastic portion is repetitively reduced.

Another embodiment includes an optional anchoring mechanism which allows a length segment of the elastic portion to be adjusted between the handles, so as to allow, for example, adaptability for users of various height or stature, or the resistance against elongation to be varied during use of the device for resistance training (shortening of the distance between handles thereby increasing the resistance against elongation, and lengthening thereof making the exercise easier to perform). The anchoring mechanism serves to selectively secure the elastic portion at a position along the length of the elastic portion within the handle after a length between handles is selected.

The above, and other objects, features and advantages of the present invention will become apparent from the following description read in conjunction with the accompanying drawings.

DETAILED DESCRIPTION OF THE PREFERRED EMBODIMENT

Figure 1:
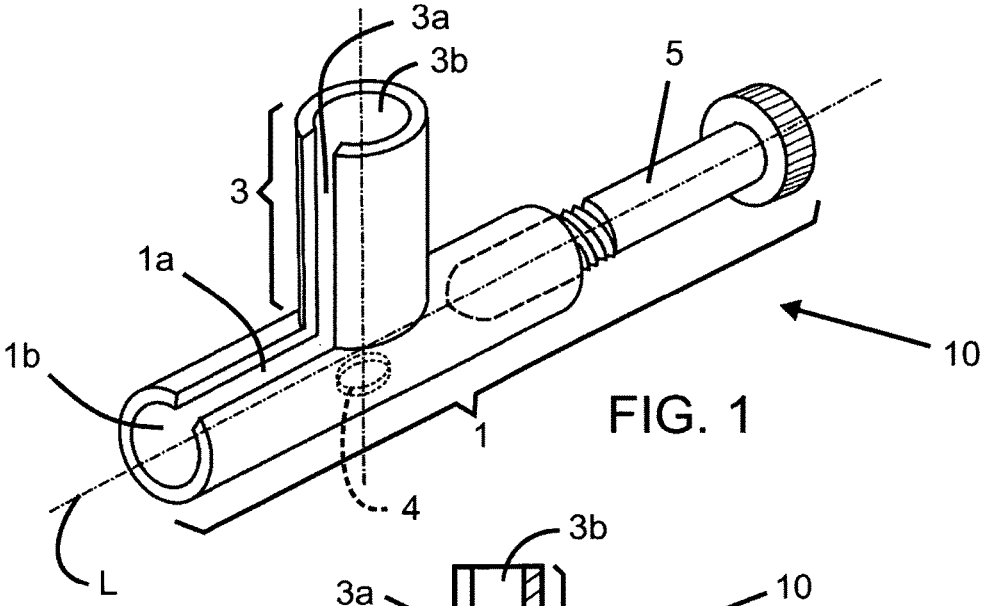
FIG. 1 is perspective view of an embodiment of a handle of an exercise apparatus according to the invention.

Referring now to the figures, and in particular FIG. 1, an embodiment of a specialized handle, a pair of which comprises a portion of an exercise apparatus according to the invention, is depicted generally at 10. The attachment of handle 10 to other portions of the assembled apparatus will be described following a description of the structural features and options of the handle 10 alone.

Handle 10 includes a grip portion 1 having a longitudinal handle grip axis L. Grip portion 1 includes a slotted opening 1*a* into a coaxial bore 1*b* which runs codirectionally with handle grip axis L, and has a width that is narrower than an elastic portion 20 (not shown in FIG. 1) when in an un-stretched state, the elastic portion comprising at least one flexible elastic member which resists stretchable elongation and which substantially returns to an original length upon release of an applied stress causing the elongation, conveniently comprising, for example, a conventional bungee cord (or two or more bungee cords, for example, optionally braided, etc., for increased resistance) or a simple elastic (rubber or other elastomer band or cable).

Optionally, handle 10 further includes an extension portion 3 arranged crosswise to the grip portion 1, which includes a bore 3*b* communicative with the coaxial bore 1*b* running crosswise thereto, and an other slotted opening 3*a* of like or similar width to the slotted opening 1*a* in the grip portion 1 and contiguous therewith. A hole 4 is optionally provided on a side of the grip portion 1 opposite to the slotted opening 1*a* to provide a convenient manner of attachment of handles 10 to elastic portion 20, as will be described in further detail below.

Figure 4A:
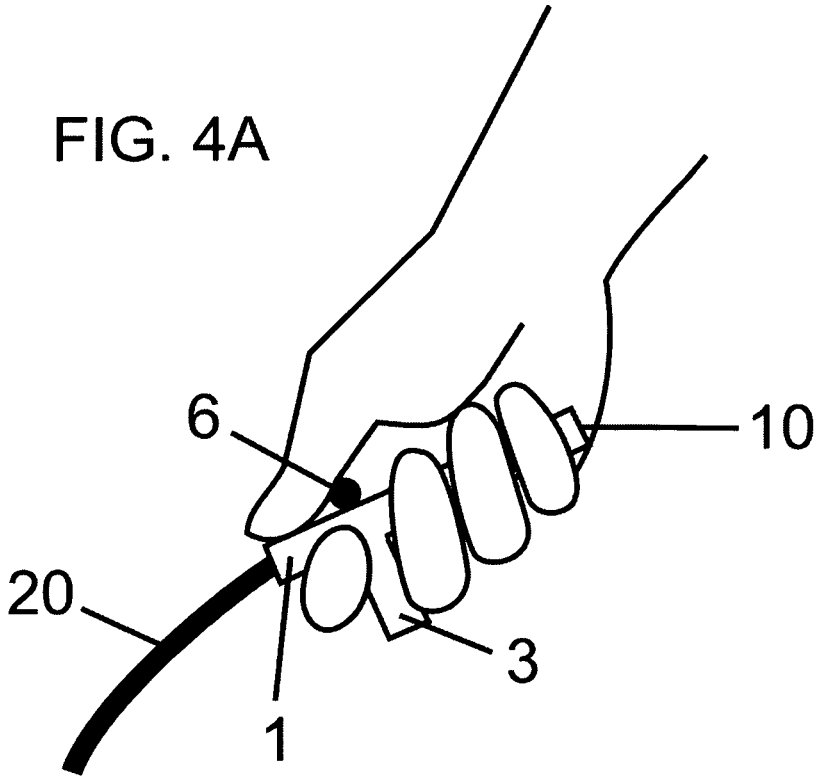
FIG. 4A is an explanatory view depicting a typical hand position when using the exercise apparatus as a jump rope.
Figure 4B:
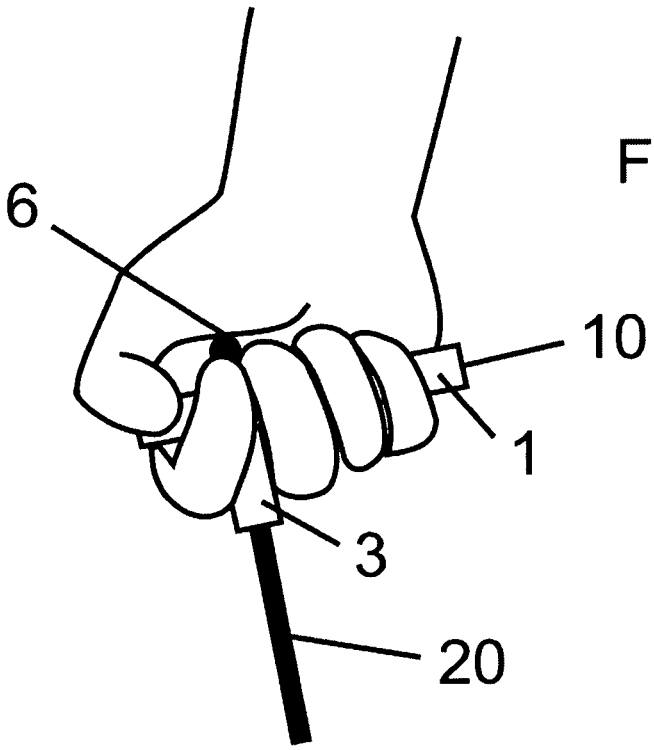
FIG. 4B is an explanatory view depicting a typical hand position when using the exercise apparatus for resistance training or stretching.
Figure 5:
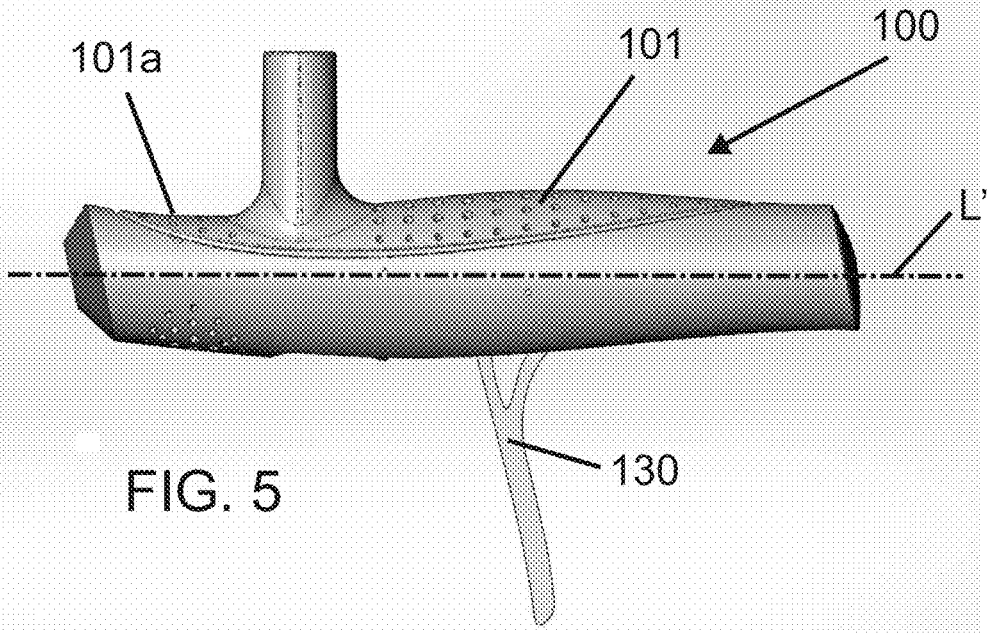
FIG. 5 is a side perspective view of another embodiment of a handle of an exercise apparatus according to the invention.
Figure 6:
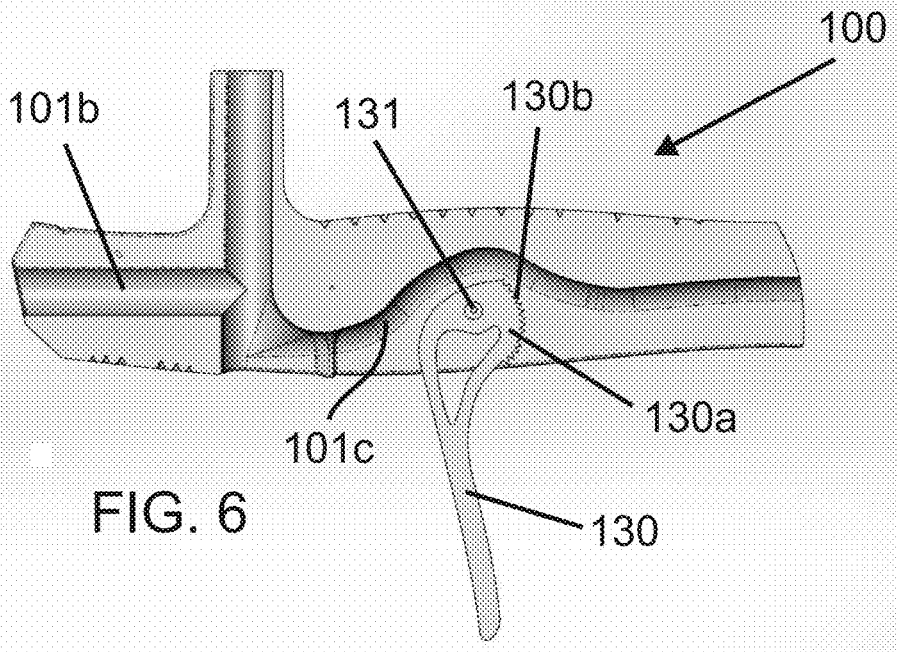
FIG. 6 is a cross-sectional view of the embodiment of FIG. 5.

As an additional option, a grip length adjustment mechanism is provided to allow selective adjustment of a length of grip portion 1, conveniently comprising a screw portion 5 that is threadably engageable with corresponding threads provided at an end region of bore 1*b*. As can be seen from the illustrated example of the figures, the un-slotted side of grip portion 1 is advantageously, though not necessarily longer than the slotted side to facilitate gripping in a hand of a user, as can be best seen in FIGS. 4A and 4B.

Figure 3A:
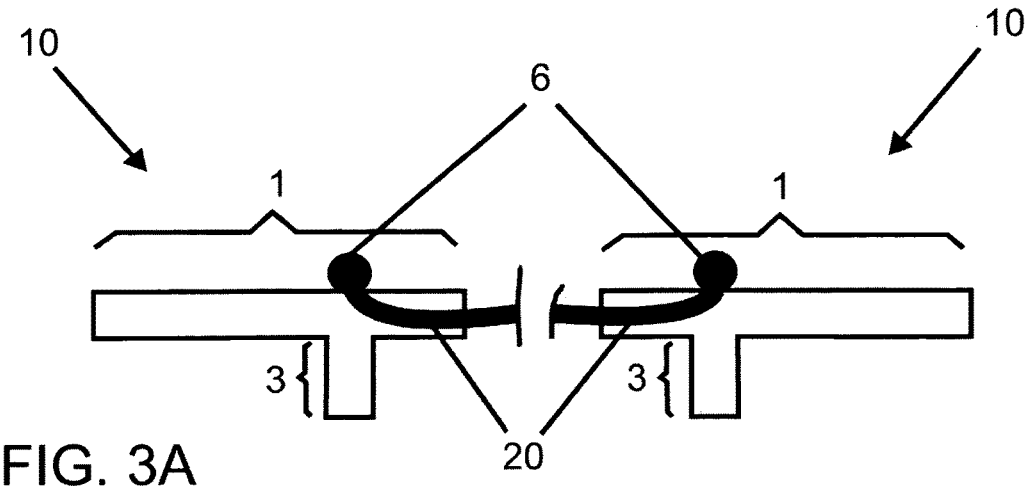
FIG. 3A is a partial schematic depiction the exercise apparatus in accordance with an embodiment of the invention shown in the a first orientation suited for use as a jump rope.
Figure 3B:
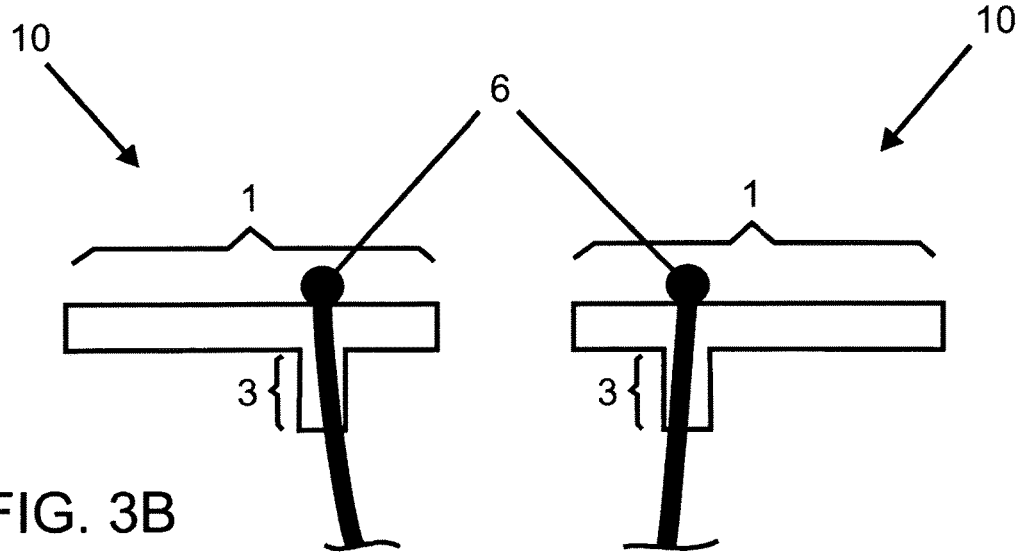
FIG. 3B is a partial schematic depiction the exercise apparatus in accordance with an embodiment of the invention shown in the a second orientation suited for resistance training and stretching.

As shown in schematic representation in FIGS. 3A and 3B, a pair of handles 10 are carried on the elastic portion 20 in spaced apart locations therealong, and are structurally configured to allow selective orientation of an extended direction of the elastic portion 20 either codirectional with the handle grip axis 1 (FIG. 3A) or crosswise thereto (FIG. 3B).

When the apparatus is used for aerobic exercise, the elastic portion 20 is generally in a first orientation relative to each of the handles 10, in which the extended direction of the elastic portion 20 is codirectional with the handle grip axis L, as shown in FIG. 3A. The handle is structurally configured to allow the elastic portion 20 to be moved to a second orientation in which the extended direction of the elastic portion is oriented crosswise to the handle grip axis, as shown in FIG. 3B. When in this second orientation, the exercise apparatus is generally best suited to use in resistance training and/or for stretching purposes.

Figure 2A:
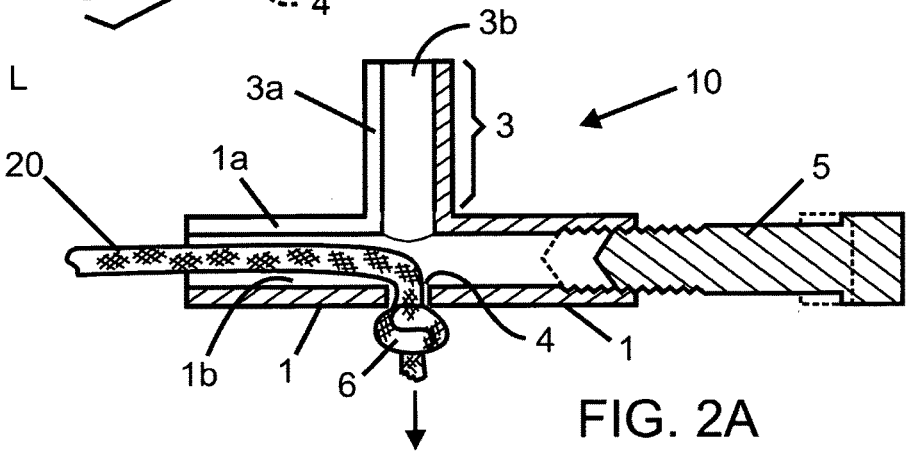
FIG. 2A side cross-sectional view of the handle of FIG. 1 showing an elastic portion in an orientation relative to the handle portion suited for aerobic use as a jump rope.
Figure 2B:
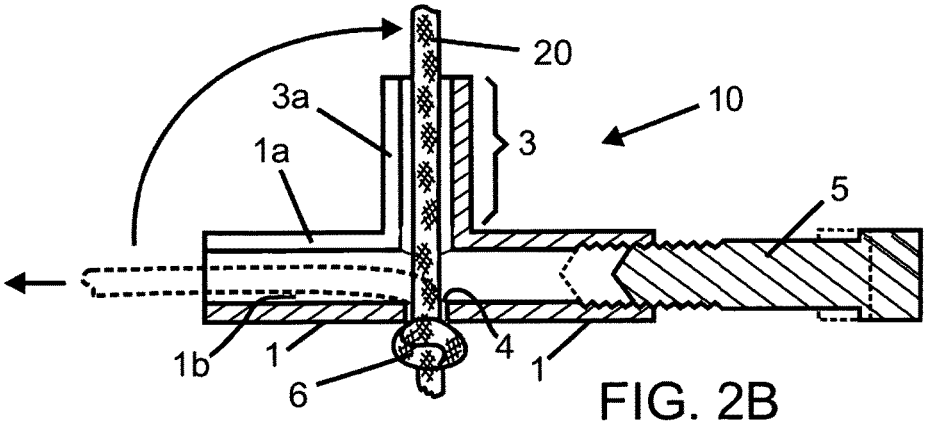
FIG. 2B is a side cross-sectional view of the handle of FIG. 1 showing the elastic portion moved from the orientation in FIG. 2A to another orientation relative to the handle portion suited for resistance training and stretching.

Turning now to FIGS. 2A and 2B, the functioning of the particularly advantageous embodiment depicted in FIG. 1 will be described. As described above, each of the pair of handles 10 includes bore 1*b* coaxial with the handle grip axis L through which the elastic portion 20 is receivable when the apparatus is in the first orientation suited for use as a jump rope, as shown in FIG. 2A. The handles 10 are carried on the elastic portion 20 in spaced apart locations therealong, and each of opposed ends of the elastic portion 20 is configured in a manner which prevents separation of the elastic portion 20 from the handles 10. This is conveniently accomplished by the provision of hole 4 in the grip portion 1 through which the ends of the elastic portion 20 are passed and tied to form a knot 6. As such, the handles 10 are slidable along the elastic portion 20 to allow an adjustment of a distance between the handles 10, while at the same time, removal of the handles 10 is prevented past the knots 6 when they are moved further apart to the opposed ends of the elastic portion 20.

As mentioned previously, slotted opening 1*a* provided in the grip portion 1 is narrower than a width of the elastic portion 20 when in an un-stretched state, such that the elastic portion 20 is captively held within the coaxial bore 1*b* for jump rope activity in the first orientation (See FIG. 2A). When the user decides to engage in resistance training or stretching, he/she simply stretches the elastic portion 20 until the width thereof is reduced sufficiently to allow the elastic portion 20 to clear the slotted opening 1*a*, thereby allowing the elastic portion 20 to be freed from the coaxial bore 1*b*, and moved into the second orientation crosswise to the coaxial bore 1*b* (See FIG. 2B).

Also, as described above, in accordance with a particularly advantageous embodiment, the handles 10 each further includes extension portion 3 arranged crosswise to the grip portion 1, which also includes bore 3*b* communicative with the coaxial bore 1*b* running crosswise thereto, and the other slotted opening 3*a* of like or similar width to the slotted opening 1*b* in the grip portion 1 and contiguous therewith. Such configuration allows the elastic portion 20 to be moved between the first and second orientation simply by maintaining a stretched state of the elastic portion 20 which sufficiently reduces the width of the elastic portion 20 to allow manually directed transfer of the elastic portion 20 to and from each of the bore 1*b* (first orientation shown in FIG. 2A) and the coaxial bore 3*b* (second orientation shown in FIG. 2B). Removal of the stretching force causes the width of the elastic portion 20 to return to a size which inhibits removal of the elastic portion 20 through either of the slots 1*b*, 3*b*. Since the forces acting on the elastic portion 20 during resistance training or stretching are codirectional with the bore 3*b* of the extension portion 3 of the handle 10, dislodging of the elastic portion 20 from the bore 3*b* of the extension portion 3 does not occur through the slotted opening 3*a*, even though the width of the elastic portion 20 is repetitively reduced.

It is noted that the optional portions and feature mentioned can be omitted and replaced with simpler structure without departure from the invention. For example, extension portion 3 can be omitted entirely, and replaced with a hole in a location along grip portion 1 coinciding with that of bore 3*b*. Similarly, while the manner of attachment of handle 10 to elastic portion 20 is achieved conveniently by knot 6 at an end of elastic portion 20 strung through a hole in grip portion 1, other structure for achieving mutual attachment may be used alternatively without departure from the invention. Moreover, in the event a knot is used, the position of hole 6 need not be as shown and described, and can be positioned in any other suitable location.

Another handle embodiment is depicted in FIGS. 5, 6, 7A and 7B, generally designated by the numeral 100. As with handle 10, handle 100 also includes a grip portion 101 having a longitudinal handle grip axis L'. Grip portion 101, by analogy, also includes a slotted opening 101*a* into a coaxial bore 101*b* which runs codirectionally with handle grip axis L', and has a width that is narrower than an elastic portion 120 (shown in FIGS. 7A and 7B) when in an un-stretched state. The elastic portion comprises at least one flexible elastic member which resists stretchable elongation and which substantially returns to an original length upon release of an applied stress causing the elongation, conveniently comprising, for example, a conventional bungee cord, etc, as the previous embodiment.

Figure 7A:
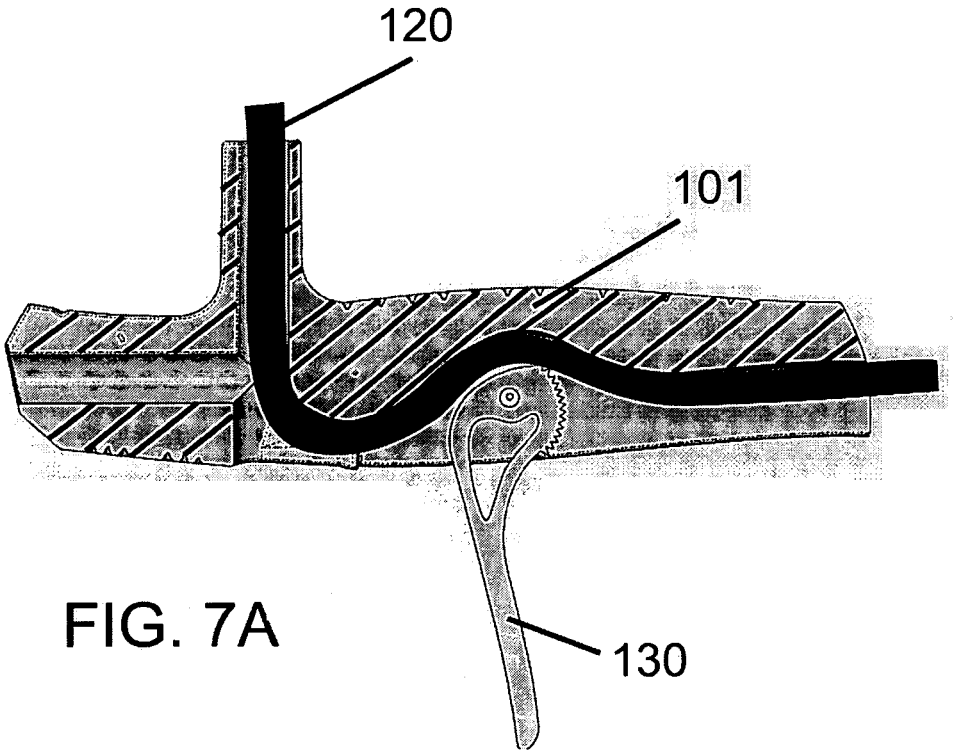
FIG. 7A is an explanatory diagram showing the operation of the embodiment of FIGS. 5 and 6, with an optional anchoring mechanism in an open position.
Figure 7B:
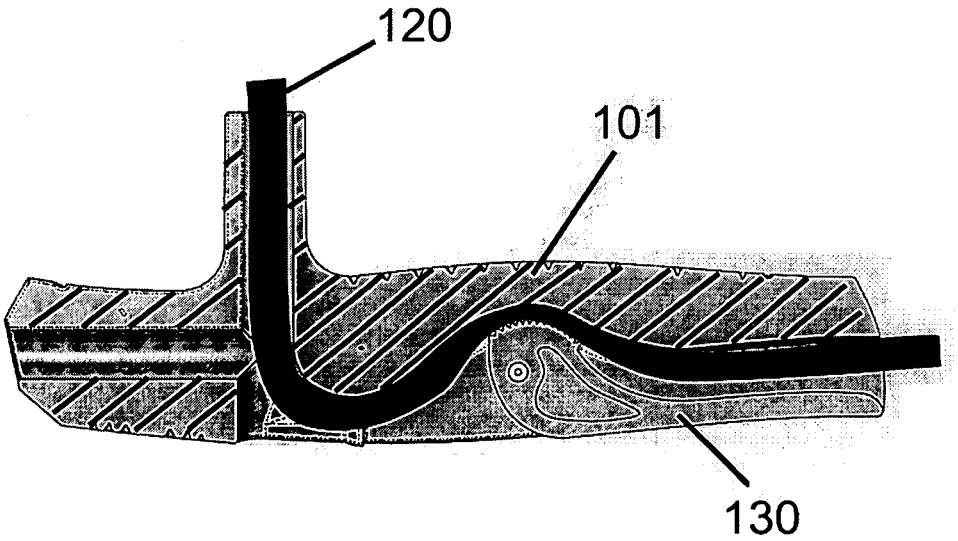
FIG. 7B is an explanatory diagram showing the operation of the embodiment of FIGS. 5 and 6, with the optional anchoring mechanism in a closed position in which the anchoring function is demonstrated.

Functioning of the apparatus according to the alternative embodiment of FIGS. 7A and 7B) is analogous to the prior embodiment, and therefore the details of the manner of providing the dual function of aerobic exercise and resistance training by orientational redirection of the elastic portion 120 is omitted as being redundant. In essence, the present embodiment differs from the prior described embodiment only in regards to the stylized handle shape and the optional provision of an anchoring mechanism for allowing selective adjustment of a length of the elastic portion between the two handles, and reliable securement in such spaced apart condition.

As in the previous embodiment, a pair of the handles 100 are carried on the elastic portion 120 in spaced apart locations therealong, and each of opposed ends of the elastic portion 20 is advantageously configured in a manner which prevents separation of the elastic portion 20 from the handles 10. Rather than being knotted on a side of a hole in the grip portion 101 through which the ends of the elastic portion 120 are passed, an anchoring mechanism is provided which is operable to selectively secure the elastic portion 120 at a selected position along a length thereof, and prevent movement of the elastic portion 120 relative to each handle 100.

As depicted, the anchoring mechanism conveniently comprises a locking arm 130 pivotably mounted to the handle 100, and movable between an open position in which it does not exert pressure on the elastic portion 120 arranged within a handle bore 101*c* (shown in FIG. 7A), and a closed position in which it applies compressive forces on the elastic portion 120 within handle bore 101*c* cross-wise to a longitudinal extent thereof (shown in FIG. 7B). As such, the handles 100 are slidable along the elastic portion 120 to allow an adjustment of a distance between the handles 100 when the locking arm 130 is open, as shown in FIG. 7A, and lockable relative to the elastic portion 120 when the locking arm 130 is pivoted closed, as shown in FIG. 7B.

As shown in the figures, an engagement portion 130*a* of locking arm 130 is asymmetric about a pivot 131 to accomplish the anchoring function when the locking arm 130 is pivoted to the closed position, and optionally includes teeth 130*b* which contact and compress the elastic portion when rotated into the closed position of FIG. 7B, and insure a reliable securement against slippage of the elastic portion relative to the handles 100 even when significant stretching forces are applied during resistance training.

While the anchoring mechanism can be used when the elastic portion 120 is oriented in a jump rope position extending through coaxial bore 101*b*, for example to make the size of the exercise apparatus customizable to users of different stature, the length adjustment capability of elastic portion 120 provided thereby is particularly useful also in allowing for the adjusting of tensioning force for varying a degree of resistance against elongation for different levels of resistance training accomplished by a shortening or lengthening of the segment portion of the elastic portion between the pair of handles 100. For example, a user can incrementally increase the resistance of a resistance training workout by progressively decreasing a distance between the handles (shortening of the elastic portion by use of the anchoring mechanism).

Figures 8A, 8B, 8C, 8D:
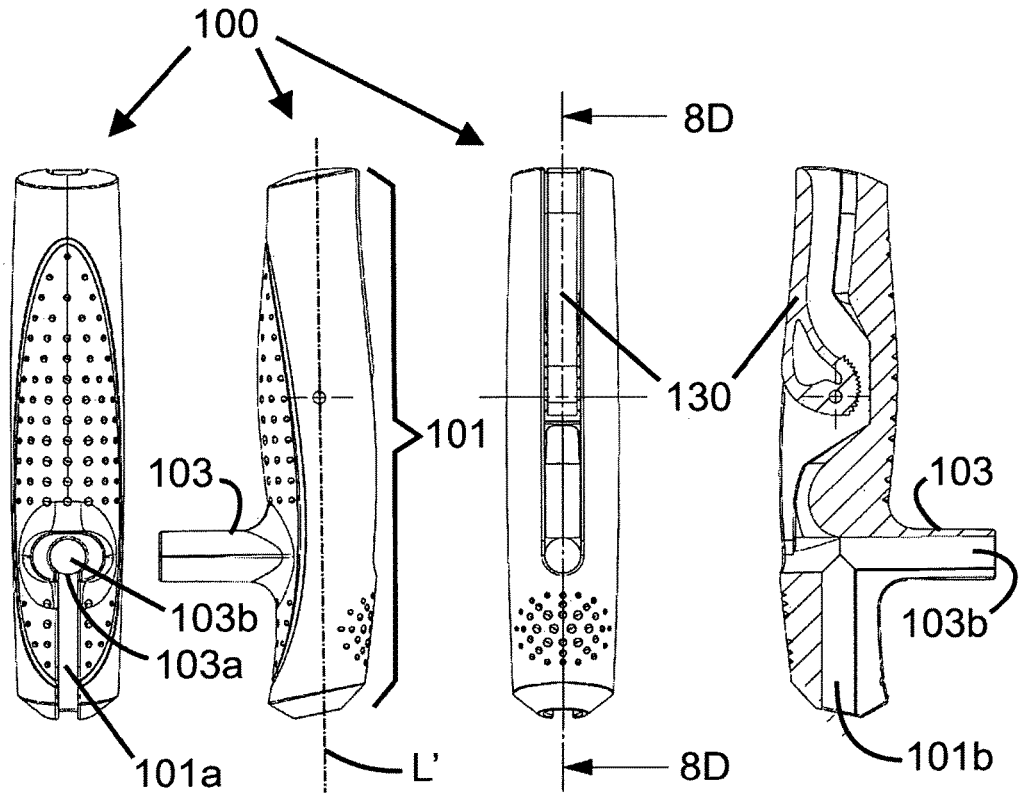
FIG. 8A is a top plan view of the handle embodiment of FIGS. 5 and 6.
FIG. 8B is a side elevational view of the handle embodiment of FIGS. 5 and 6.
FIG. 8C is a bottom plan view of the handle embodiment of FIGS. 5 and 6.
FIG. 8D is a cross-sectional view the handle embodiment of FIGS. 5 and 6 taken along line 8D-8D in FIG. 8C.

FIGS. 8A-8C depict top, side and bottom views, respectively, of the handle embodiment described above with reference to FIGS. 5, 6, 7A and 7B. In addition to the elements analogous to the embodiment of FIGS. 1, 2A and 2B included in handle 100 described above, handle 100 also analogously optionally includes an extension portion 103 arranged crosswise to the grip portion 101, which includes a bore 103*b* communicative with the coaxial bore 101*b* running crosswise thereto, and another slotted opening 103*a* of like or similar width (relative to the elastic portion) to the slotted opening 101*a* in the grip portion 101 and contiguous therewith.

Figure 9A:
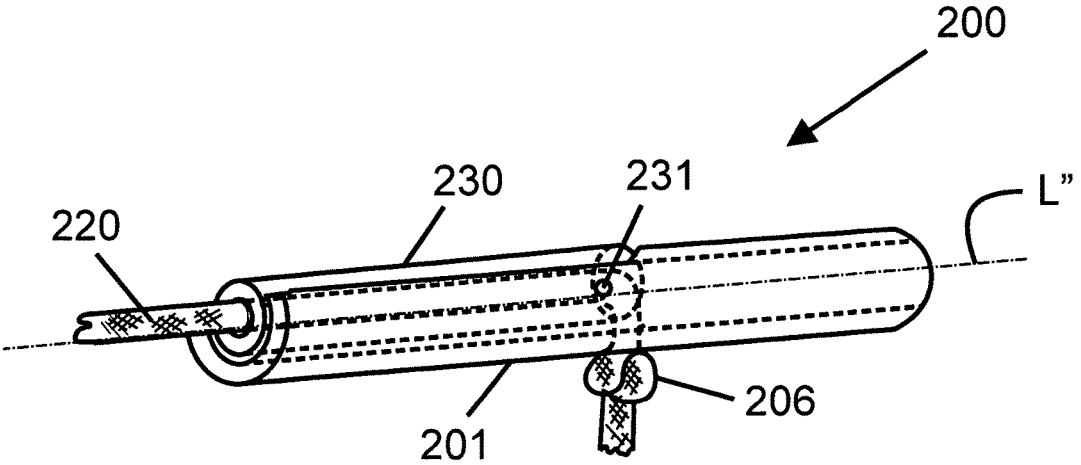
FIG. 9A depicts a further embodiment employing an alternative configuration allowing shifting of an orientation of a handle grip axis to be adjusted relative to an extended direction of an elastic portion showing the elastic portion in an orientation relative to the handle portion suited for aerobic use as a jump rope.
Figure 9B:
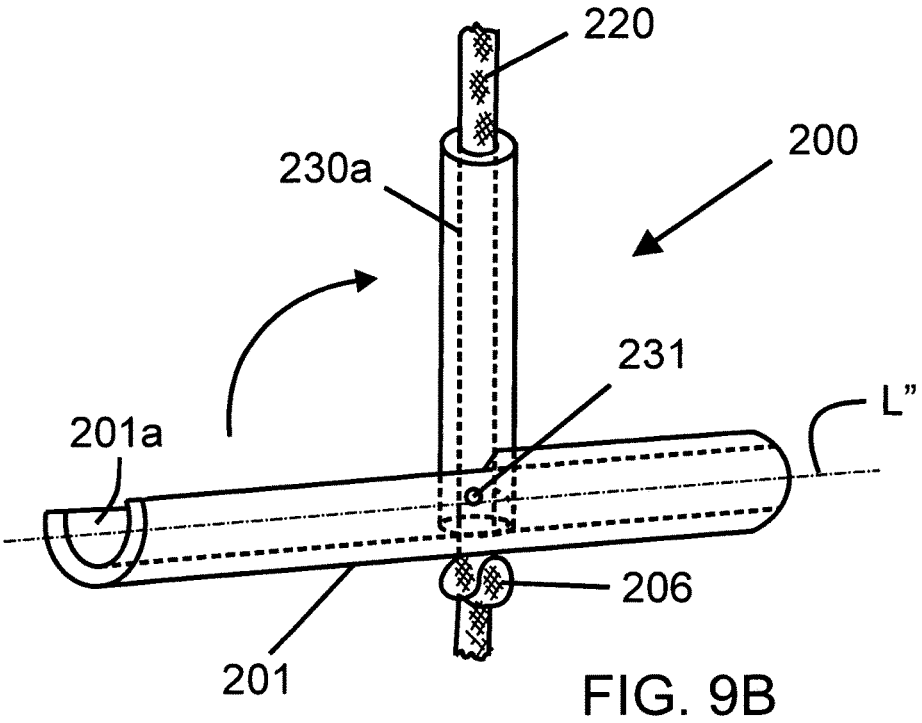
FIG. 9B is another depiction of the embodiment of FIG. 9A showing the elastic portion member moved from the orientation in FIG. 2A to another orientation relative to the handle portion suited for resistance training and stretching.

Referring now to FIGS. 9A and 9B, an alternative handle embodiment is depicted, generally designated by the numeral 200. In accordance with this embodiment, rather than achieving a change in orientation of a handle grip axis L" relative to an extended direction of an elastic portion 220, from one which is codirectionally oriented relative to the elastic portion to another which is oriented crosswise thereto by passage of a stretched, and thereby reduced width segment of elastic portion 220, through a slotted opening, as in the previously described embodiments, the presently described embodiment instead utilizes a pivot arm 230 movable mounted to a grip portion 201 via a pivot 231. In this embodiment, elastic portion 220 extends from a point of attachment of each of opposed ends of the elastic portion 220 to each handle 200 (conveniently by a knot 206 formed at an end of or at another location along elastic portion 220) through a bore 230*a* in pivot arm 230, much in the same manner as the embodiment depicted in FIGS. 2A and 2B.

FIG. 9A depicts a positioning analogous to that of FIG. 2A, wherein the handle is generally suited to aerobic training, such as when used as a jump rope. When in this positioning, pivot arm 230 optionally nests within a cutaway portion 201*a* of grip portion 201 (or could alternatively optionally rest in a codirectional position adjacent thereto, if not so nested).

When a user desires a positioning more suited to resistance training or stretching, pivot arm 230 is moved in the direction of the arrow shown in FIG. 9B, lifting the pivot arm 230, along with the elastic portion 220 threaded therethrough, to the position shown in FIG. 9B, and in which the elastic portion 230 is oriented crosswise to the handle grip axis L".

Use of this embodiment is analogous with that of the previously described embodiments, and therefore further description is omitted as being redundent.

A handle in accordance with the invention can be made from any suitable material, for example, wool, metal, plastic, plastic/rubber combinations, etc. without departure from the invention. ABS plastic was found to be one such acceptable material, but is not to be considered limiting to the contemplated scope of the invention.

As mentioned above, the elastic portion can be a conventional bungee cord, selected with a desired stretch limit and/or counterforce value. For example, for illustration purposes only, a suitable bungee cord was tested which was 8 mm in diameter and 3 meters long. Optimal elasticity, which is not to be considered limiting of the invention in any manner, and which is given simply for illustration purposes for the cord, was measured with stretch test, and the results were about 210% to about 247% elongation.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention.

What is claimed is:

1. An exercise apparatus, comprising:

a flexible elastic portion comprised of at least one elastic member of elongate dimension; and a pair of handles being attached to said elastic portion in spaced apart positions therealong in an elongated direction thereof, each of said handles having a handle grip portion extending along a handle grip axis and including a structural configuration which allows the alternate orientation of said elastic portion in a first attached position in which said elongated direction extends from said handle grip portion crosswise to said handle grip axis and a second attached position in which said elongated direction extends from said handle grip portion codirectional with said handle grip axis in order to achieve a configuration respectively suited to aerobic activity, or to resistance training and stretching.

2. An exercise apparatus according to claim 1, further comprising an anchoring mechanism movable between a locked position and an unlocked position so as to be operable to secure each of said handles to a selected longitudinal position of said elastic portion such that relative movement between the handles and the elastic portion is inhibited when moved to a locking position, and allow relative movement between the handles and the elastic portion when in the unlocked position so as to permit selection of a desired length segment of said elastic portion between the handles.

3. An exercise apparatus according to claim 1, wherein said elastic portion comprises at least one bungee cord.

4. An exercise apparatus according to claim 1, wherein each of said handles further includes an extension portion joined with said handle grip portion at a position between opposed ends of the handle grip portion which extends crosswise to said handle grip axis along an extension axis.

5. An exercise apparatus according to claim 4, wherein said handle grip portion is comprised of a first grip segment being disposed on a one side of said extension portion and a second grip segment being disposed on an opposite side of said extension portion, a one of said first and second grip segments including a first coaxial bore and a first slotted opening into said first coaxial bore, said first slotted opening being codirectional with said first coaxial bore and facing generally in a common direction with said extension axis, said extension portion including a second coaxial bore communicative with said first coaxial bore and a second slotted opening into said second coaxial bore, said first coaxial bore of each of said handles receiving respective end segments of said elastic portion, said handles being captively held on said elastic portion, a diameter of said elastic portion being greater than a first width of said first slotted opening in an unstretched state such that said elastic portion is maintained in said unstretched state in said first bore.

6. An exercise apparatus according to claim 5, wherein said handle grip portion includes a hole communicative with said first and second coaxial bores through which an end of the elastic portion passes, a knot being present on a side opposite to said first and second coaxial bores whereby the handles are slidable along the elastic portion to allow an adjustment of a distance between the handles, while concomitantly inhibiting removal of the handles from the elastic portion.

7. An exercise apparatus according to claim 1, wherein said elongated direction extends from said handle grip portion in general alignment with said handle grip axis when in said second attached position.

8. A method of performing at least two forms of exercise using a same apparatus, comprising:

providing a pair of spaced apart handles interconnected by an extended segment of a flexible elastic portion extending therebetween, each of said handles having a handle grip portion arranged generally along a handle grip axis;

orienting said elastic portion relative to said handle grip axis in a first positioning in which said extended segment of said elastic portion exits said handles in a respective direction which is one of crosswise to or codirectional with said handle grip axis of each of said handles; and reorienting said elastic portion relative to said handle grip axis in a second positioning in which said extended segment of said elastic portion exits said handles in another direction which is a remaining one of crosswise to, or codirectional with, said handle grip axis of each of said handles different from said direction in said orienting;

respectively performing, with the same apparatus, at least one of strength training or stretching when said elastic portion exits said handles crosswise to said handle grip axis of each of said handles by stretching the flexible elastic portion and aerobics when said elastic portion exits said handles codirectional with said handle grip axis of each of said handles.

9. A method according to claim 8, further comprising:

instructing use of said apparatus by holding said handles each in respective hands of a user; and further instructing use of said apparatus for aerobic exercise when said elastic portion exits said handles codirectional to said handle grip axis and for resistance training including at least one of strength training or stretching when said elastic portion exits said handles crosswise to said handle grip axis.

10. A method according to claim 8, wherein said handle grip portion of each of said handles includes a first coaxial bore and a first slotted opening into said first coaxial bore, said first slotted opening being codirectional with said first coaxial bore, said first coaxial bore of each of said handles receiving respective end segments of said elastic portion, said handles being captively held on said elastic portion, a diameter of said elastic portion being greater than a first width of said first slotted opening in an unstretched state.

11. A method according to claim 10, wherein said reorienting includes applying stretching force to said elastic portion at least in a region adjacent to each of said handles effective to reduce a thickness thereof sufficiently as to allow said end segments of said elastic portion to be brought at least one of into or out of the first coaxial bore through said first slotted opening.

12. A method according to claim 10, wherein said grip portion of each of said handles further includes an extension portion joined with said handle grip portion at a position between opposed ends of the handle grip portion and extending crosswise to said handle grip axis along an extension axis, said handle grip portion being comprised of a first grip segment which is on a one side of said extension portion and a second grip segment on an opposite side of said extension portion, said first coaxial bore facing generally in a common direction with said extension axis, said extension portion including a second coaxial bore communicative with said first coaxial bore and a second slotted opening into said second coaxial bore, said diameter of said elastic portion being greater than a second width of said second slotted opening in an unstretched state, said reorienting includes applying stretching force to said elastic portion at least in a region adjacent to each of said handles effective to reduce a thickness thereof sufficiently as to allow said end segments of said elastic portion to be brought at least one of into or out of the second coaxial bore through said second slotted opening.

13. An exercise apparatus, comprising:

a flexible elastic portion comprised of at least one elastic member of elongate dimension in an extended direction thereof; and a pair of spaced apart handles interconnected by said elastic portion, each of said handles including a handle grip portion extending along a handle grip axis, said handle grip portion being adapted to be gripped by a hand of a user, each of said handles further including an extension portion joined with said handle grip portion at a position between opposed ends of the handle grip portion and extending crosswise to said handle grip axis along an extension axis, said handle grip portion being comprised of a first grip segment which is on one side of said extension portion and a second grip segment on an opposite side of said extension portion, a one of said first and second grip segments including a first coaxial bore and a first slotted opening into said first coaxial bore, said first slotted opening being codirectional with said first coaxial bore and facing generally in a common direction with said extension axis, said extension portion including a second coaxial bore communicative with said first coaxial bore and a second slotted opening into said second coaxial bore, said first coaxial bore of each of said handles receiving respective end segments of said elastic portion, said handles being captively held on said elastic portion, a diameter of said elastic portion being greater than a first width of said first slotted opening in an unstretched state such that said elastic portion is maintained in said unstretched state in said first bore.

14. An exercise apparatus according to claim 13, wherein said elastic portion includes a width greater than a second width of said second slotted opening in said unstretched state such that said elastic portion is maintained in said unstretched state in said second bore.

15. An exercise apparatus according to claim 13, further comprising an anchoring mechanism movable between a locked position and an unlocked position so as to be operable to secure each of said handles to a selected longitudinal position of said elastic portion such that relative movement between the handles and the elastic portion is inhibited when moved to a locking position, and allow relative movement between the handles and the elastic portion when in the unlocked position so as to permit selection of a desired length segment of said elastic portion between the handles.

16. An exercise apparatus according to claim 13, further comprising:

a grip length adjustment mechanism to allow selective adjustment of a length of said handle grip portion.

17. An exercise apparatus according to claim 16, wherein said grip length adjustment mechanism includes a screw portion that is threadably engageable with corresponding threads provided at an end region of said first coaxial bore.

18. An exercise apparatus according to claim 13, wherein said one of said first and second grip segments which includes said first slotted opening is shorter than a remaining one of said first and second grip segments.

19. An exercise apparatus according to claim 13, wherein said flexible elastic portion comprises at least one bungee cord.

* * * * *